US006257017B1

(12) United States Patent
Kimble

(10) Patent No.: US 6,257,017 B1
(45) Date of Patent: Jul. 10, 2001

(54) PROCESS FOR PRODUCING A DISPLACEMENT GAS TO UNLOAD PRESSURIZED LIQUEFIED GAS FROM CONTAINERS

(75) Inventor: E. Lawrence Kimble, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/464,177

(22) Filed: Dec. 16, 1999

Related U.S. Application Data

(60) Provisional application No. 60/112,802, filed on Dec. 18, 1998.

(51) Int. Cl.[7] ..... F25J 3/00
(52) U.S. Cl. ..... 62/611
(58) Field of Search ..... 62/48.1, 50.1, 62/611

(56) References Cited

U.S. PATENT DOCUMENTS

| | | | |
|---|---|---|---|
| 334,481 | 1/1886 | Sone . | |
| 1,753,785 | 4/1930 | Heylandt . | |
| 2,435,332 | 2/1948 | Van Vleet et al. | 62/1 |
| 2,795,937 | 6/1957 | Sattler et al. | 62/1 |
| 2,940,268 | 6/1960 | Morrison | 62/7 |
| 2,972,873 | 2/1961 | Peet et al. | 62/51 |
| 2,975,608 | 3/1961 | Morrison | 62/53 |
| 2,983,409 | 5/1961 | Henry | 222/399 |
| 3,004,509 | 10/1961 | Leroux | 114/74 |
| 3,018,632 | 1/1962 | Keith | 62/9 |
| 3,145,680 | 8/1964 | Farkas et al. | 114/74 |
| 3,232,725 | 2/1966 | Secord et al. | 48/190 |
| 3,257,813 | 6/1966 | Hashemi-Tafreshi | 62/23 |
| 3,293,011 | 12/1966 | Lewis et al. | 48/190 |
| 3,298,805 | 1/1967 | Secord et al. | 48/190 |
| 3,324,670 | 6/1967 | Van Kleef | 62/55 |
| 3,365,898 | 1/1968 | Van Kleef | 62/55 |
| 3,422,779 | 1/1969 | Becker | 114/74 |

(List continued on next page.)

FOREIGN PATENT DOCUMENTS

WO 97/16678 5/1997 (WO) ..... F17C/1/00

OTHER PUBLICATIONS

Bennett, C. P. Marine Transportation of LNG at Intermediate Temperature, *CME* (Mar. 1979), pp. 63–64.

Faridany, E. K., Secod, H.C, O'Brien, J. V., Pritchard, J. F., and Banister, M. The Ocean Phoenix Pressure–LNG System, *GASTECH 76* (1976), New York, pp. 267–280.

Faridany, E. K., Ffooks R. C., and Meikle, R. B. A Pressure LNG System, European Offshore Petroleum Conference & Exhibition (Oct. 21–24, 1980), vol. EUR 171, pp. 245–254.

Broeker, R.J. CNG and MLG–New Natural Gas Transportation Processes, *American Gas Journal* (Jul. 1969) pp. 138–140.

(List continued on next page.)

*Primary Examiner*—William Doerrler
*Assistant Examiner*—Malik N. Drake
(74) *Attorney, Agent, or Firm*—Gary Lawson

(57) ABSTRACT

A process is disclosed for producing a displacement gas to be used in displacing a pressurized liquefied gas from one or more containers. A portion of the liquefied gas to be displaced is further pressurized and it is then separated into a first fraction and a second fraction. The first fraction is expanded by a suitable expansion means, and the expanded fraction is passed to a separation means to produce a liquid stream and a gas stream. The second fraction is heated to covert it to a vaporous product stream. A portion of the vaporous product stream is withdrawn, expanded, and passed to the separation means. A gas stream produced by the separation means is expanded, and it is then available for use as a displacement gas for displacing liquefied gas from one or more containers.

9 Claims, 3 Drawing Sheets

U.S. PATENT DOCUMENTS

| | | | |
|---|---|---|---|
| 3,477,509 | 11/1969 | Arendt | 166/252 |
| 3,535,885 | 10/1970 | Frijlink | 62/9 |
| 3,690,115 | 9/1972 | Clayton | 62/49 |
| 3,830,180 | 8/1974 | Bolton | 114/74 |
| 3,831,811 | 8/1974 | Becker | 222/1 |
| 3,842,613 | 10/1974 | Becker | 62/50 |
| 3,877,240 | 4/1975 | Kniel et al. | 62/50 |
| 4,182,254 | 1/1980 | Secord | 114/74 |
| 4,292,909 | 10/1981 | Conway | 114/74 |
| 4,315,407 | 2/1982 | Creed et al. | 62/53 |
| 4,446,804 | 5/1984 | Kristiansen et al. | 114/74 |
| 4,609,390 | 9/1986 | Wilson | 62/21 |
| 5,199,266 | 4/1993 | Johansen | 62/8 |
| 5,211,021 | 5/1993 | Pierson | 62/50 |
| 5,231,838 | 8/1993 | Cieslukowski | 62/50 |
| 5,243,821 | 9/1993 | Schuck et al. | 62/50 |
| 5,377,723 | 1/1995 | Hilliard, Jr. et al. | 141/4 |
| 5,398,629 | 3/1995 | Wasenius | 114/74 |
| 5,454,408 | 10/1995 | DiBella et al. | 141/197 |
| 5,476,126 | 12/1995 | Hilliard, Jr. et al. | 141/63 |
| 5,513,680 | 5/1996 | Hilliard, Jr. et al. | 141/4 |
| 5,950,453 | 9/1999 | Bowen et al. | 62/612 |
| 5,956,971 | 9/1999 | Cole et al. | 62/623 |
| 6,016,665 | 1/2000 | Cole et al. | 62/612 |
| 6,023,942 | 2/2000 | Thomas et al. | 62/613 |

OTHER PUBLICATIONS

Fluggen, Prof. E. and Backhaus, Dr. I. H. Pressurised LNG–and the Utilisation of Small Gas Fields, GASTECH78, LNG/LPG Conference (Nov. 7, 1978), Monte Carlo pp. 195–204.

Broeker, R.J. A New Process for the Transportation of Natural Gas, Proceedings Of The First International Conference On LNG (1968), Chicago, Illinois, Session No. 5, Paper 30, pp. 1–11.

Ladkany, S. G. Composite Aluminum–Fiberglass Epoxy Pressure Vessels for Transportation of LNG at Intermediate Temperature, published in Advances in Cryogenic Engineering, Materials, vol. 28, (Proceedings of the 4th International Cryogenic Materials Conference), San Diego, CA, USA, Aug. 10–14, 1981, pp. 905–913.

PROCESS FOR PRODUCING A DISPLACEMENT GAS TO UNLOAD PRESSURIZED LIQUEFIED GAS FROM CONTAINERS

This application claims the benefit of U.S. Provisional Application No. 60/112,802, filed Dec. 18, 1998.

FIELD OF THE INVENTION

This invention relates to the handling of pressurized liquefied natural gas and, more particularly, to a process for producing a displacement gas suitable for unloading containers having pressurized liquefied natural gas contained therein.

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

It has been recently proposed to transport natural gas at temperatures above −112° C. (−170° F.) and at pressures sufficient for the liquid to be at or below its bubble point temperature. For most natural gas compositions, the pressure of the natural gas at temperatures above −112° C. will be between about 1,380 kPa (200 psia) and about 4,500 kPa (650 psia). This pressurized liquid natural gas is referred to as PLNG to distinguish it from LNG, which is transported at near atmospheric pressure and at a temperature of about −162° C. (−260° F.).

If PLNG is unloaded from a container by pumping the PLNG out and allowing the container pressure to decrease, the decompression of the PLNG can lower the temperature in the container below the permitted design temperature for the container. If the pressure in the container is maintained as the PLNG is removed to avoid such temperature reduction, the vapor remaining in the container will contain a significant mass percentage of the container's original cargo. Depending upon the pressure and temperature of storage and the composition of the PLNG, the vapors may constitute from about 10 to 20 percent of the mass of PLNG in the container before the liquid was removed. It is desirable to remove as much of this gas as is economically possible while keeping the container at approximately the same temperature as the PLNG before unloading.

SUMMARY

This invention relates to a process for producing a displacement gas from a multi-component, pressurized, liquefied gas rich in methane to be used in displacing a pressurized liquefied gas from one or more containers. As a first step, the pressure of the multi-component, pressurized, liquefied gas is increased and it is then separated into a first fraction and a second fraction. The first fraction is expanded by a suitable expansion means to reduce its pressure, and the expanded fraction is passed to a separation means, such as a conventional separation means or a conventional fractionator, which produces a liquid stream and a gas stream. The second fraction is heated to convert it to a vaporous product stream. A portion of the vaporous product stream is withdrawn and the withdrawn portion is expanded to reduce its pressure and temperature. The expanded vaporous stream is then passed to the separation means. The remaining portion of the vaporous product stream is discharged from the process. The liquid product produced by the separation means is recycled by being combined with the multi-component, pressurized, liquefied gas before the multi-component, pressurized, liquefied gas is pressurized in the first step of this process. The gas stream produced by the separation means is expanded to reduce its pressure and temperature. This expanded gas stream is available for use as a displacement gas for displacing liquefied gas from one or more containers.

BRIEF DESCRIPTION OF THE DRAWINGS

The present invention and its advantages will be better understood by referring to the following detailed description and the attached drawings.

Figure 1A:
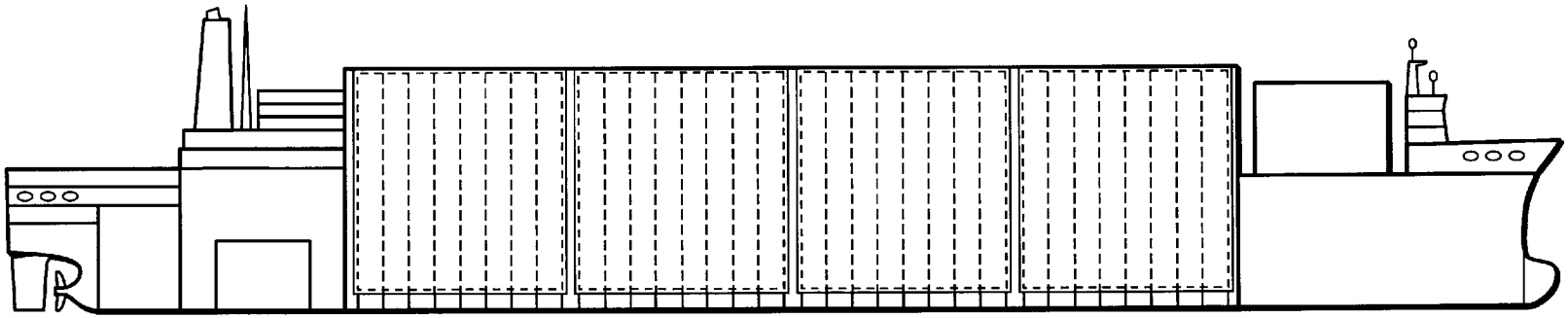
FIG. 1A is side view of a ship with a plurality of containers having pressurized liquefied gas loaded therein which can be unloaded using displacement gas produced by the process of this invention.

The flow diagrams illustrated in the drawings present processes for producing a displacement gas and for using the displacement gas to unload pressurized liquid natural gas from containers. The drawings are not intended to exclude from the scope of the invention other embodiments that are the result of normal and expected modifications of specific embodiments described in this patent. Various required subsystems such as pumps, valves, flow stream mixers, control systems, and fluid level sensors have been deleted from the drawings for the purposes of simplicity and clarity of presentation.

DETAILED DESCRIPTION OF THE INVENTION

This invention provides a process for producing from a multi-component, pressurized liquefied gas rich in methane a displacement gas for unloading one or more containers having a pressurized liquefied gas contained therein. The process of this invention is particularly applicable to discharging pressurized liquid natural gas (PLNG) from containers onboard a ship. The PLNG to be discharged from the containers will typically have a temperature above −112° C. (−170° F.) and a pressure at or above its bubble point pressure. A gas introduced into the containers to displace the PLNG therefore must also be at cryogenic temperatures, preferably at approximately the same temperature as the temperature of the liquid to be displaced, in order to minimize heating up of the containers and to minimize production of boil-off vapors.

Figure 1B:
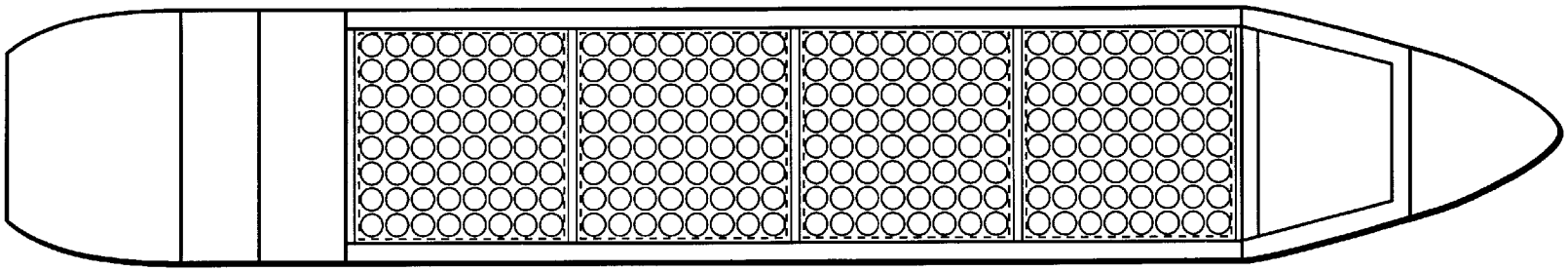
FIG. 1B is a plan view of the ship of FIG. 1A having a portion of the deck removed to show the plurality of containers.

The displacement gas produced by the practice of this invention can be used to unload PLNG from a PLNG ship generally shown in FIGS. 1A and 1B. FIG. 1A shows a side view of a suitable ship having a multiplicity of vertically elongated containers or tanks for transporting PLNG and FIG. 1B shows a plan view of the ship. It should be understood, however, that the displacement gas produced by the process of this invention is not limited to use with a particular design of a container to be unloaded. Although FIGS. 1A and 1B show a plurality of vertically elongated containers on a ship, the containers can also be horizontal or both vertical and horizontal. Use of the displacement gas is also not limited to containers on ships. The displacement gas can be used to unload storage tanks in an onshore facility. While use of the displacement gas produced by the process of this invention will be described herein with respect to unloading PLNG from a ship, use of the displacement gas is not limited to unloading PLNG. The displacement gas can be used to unload any pressurized liquefied gas at cryogenic temperatures.

The elongated containers shown in FIG. 1B are mounted within the ship's hold and are connected to piping system for selectively filling, venting, and discharging PLNG. The containers are contained in a cold box that has suitable insulation for keeping the PLNG at cryogenic temperatures. Alternatively, insulating individual tanks is possible. Each container is in the range of about 15 to 60 meters in height and has an outer diameter of approximately 3 to 10 meters. The containers may be fabricated of any suitable material capable of enduring exposure and stress at cryogenic temperatures at the pressures required to keep PLNG at or below its bubble point temperature.

The term "bubble point" as used in this description means the temperature and pressure at which the liquid begins to convert to gas. For example, if a certain volume of PLNG is held at constant pressure, but its temperature is increased, the temperature at which bubbles of gas begin to form in the PLNG is the bubble point. Similarly, if a certain volume of PLNG is held at constant temperature but the pressure is reduced, the pressure at which gas begins to form defines the bubble point. At the bubble point, the liquefied gas is saturated liquid. For most natural gas compositions, the pressure of the natural gas at temperatures above −112° C. will be between about 1,380 kPa (200 psia) and about 4,500 kPa (650 psia).

Although this description will be described with respect to unloading PLNG from a ship, this invention is not limited to unloading PLNG. The displacement gas can be used to unload any pressurized liquefied gas.

One advantage of using a cryogenic, pressurized displacement gas to discharge PLNG from containers is that the PLNG can be discharged without significantly reducing the pressure of the PLNG during the discharging step. Any significant decompression of the PLNG in the containers could reduce the temperature of the PLNG below the design temperature of the container as the PLNG flashes when the pressure drops below the bubble point temperature.

The maximum temperature of the PLNG in the ship containers to be unloaded will depend primarily on the PLNG's composition. Natural gas, which is predominantly methane, cannot be liquefied at ambient temperature by simply increasing the pressure, as is the case with heavier hydrocarbons used for energy purposes. The critical temperature of methane is −82.5° C. (−116.5° F.). This means that methane can only be liquefied below that temperature regardless of the pressure applied. Since natural gas is a mixture of liquid gases, it liquefies over a range of temperatures. The critical temperature of natural gas is typically between about −85° C. (−121° F.) and −62° C. (−80° F.). This critical temperature will be the theoretical maximum temperature of PLNG in the ship containers, but the preferred storage temperature will preferably be several degrees below the critical temperature and at a lower pressure than the critical pressure.

One embodiment of a process for producing a displacement gas in accordance with the practice of this invention will now be described with reference to FIG. 2. A PLNG stream is passed to a surge tank 80 through flow line 60. Although the PLNG can be obtained from any available source, as described in more detail below with respect to the process illustrated in FIG. 3, the PLNG is preferably obtained from the container or group of containers to be unloaded by the displacement gas.

Over time, excess vapor may buildup in the surge tank 80. This excess vapor can be removed through flow line 62, which can be connected to any suitable device depending on the design of the unloading system. Although not shown in the drawings, the excess vapor in line 62 can for example be compressed and passed into separator 84, it may be passed to a fuel gas system for powering turbines or engines, or it may be combined with a displacement gas stream 72.

PLNG liquid is passed from surge tank 80 through line 63 to a pump 61 to increase the pressure of the PLNG liquid. The pressurized PLNG exiting pump 61 (stream 64) is split into two fractions. One fraction is passed to an expansion means 86, such as a Joule-Thomson valve, which reduces the pressure and temperature of the liquid fraction before it is passed by line 65 to a separator means 84. Separator means 84 can comprise any device to produce a vapor stream and a liquid stream, such as a packed column, trayed column, spray tower, or fractionator. The other fraction of the liquid from line 64 is passed to a second pump 82 which further increases the pressure of the second liquid fraction to the desired pressure of the sales gas product to be discharged by the process. From pump 82, the PLNG is passed by line 66 to a conventional vaporizer 83 which vaporizes most, and preferably all, of the second liquid fraction. The vaporization can use conventional heating processes well known to those skilled in the art for converting liquefied natural gas to a gas product. A fraction of the gas produced by the vaporizer 83 is withdrawn from flow line 68 and expanded by an expansion means 85, such as a Joule-Thomson valve, and passed by line 67 to the separation means 84. The separation means 84 produces a vapor stream (line 70) that is rich in methane and lean in heavier components of the multi-component PLNG. Gas in line 70 is expanded by an expansion means 87, such as a Joule-Thomson valve, to reduce the temperature and pressure of the gas. The gas in line 72 is available for use in discharging PLNG from one or more containers.

The temperature of the displacement gas in line 72 can be regulated by controlling the relative amounts of flow streams in lines 65 and 67. The temperature of gas in line 72 can be reduced by increasing the amount of liquid directed from flow line 64 through flow line 65. The heat in the gas withdrawn from line 68 and passed to the separation means 84 provides energy for vaporization in the separation means 84. The optimum temperature of the displacing gas in line 72 will depend on the temperature and pressure of the liquefied gas to be displaced from a container and the pressure required to displace the liquid from the container. Those skilled in the art can optimize the temperature and pressure of the displacement gas in line 72 taking into account the teachings of the invention set forth in this patent.

One advantage of the process of this invention is that the displacement gas produced by the process will be lean in heavier hydrocarbon components that could liquefy during the displacement process. PLNG entering the process through line 60 will be a multi-component liquid that contains methane as a predominant component. The separation means 84 produces a gas stream in line 70 that is predominantly methane and a liquid stream in line 73 that is lean in methane and rich in the components that are heavier than methane. Stream 73 is pressurized by pump 88 and passes through line 74 before being mixed upstream of pump 82.

Figure 3:
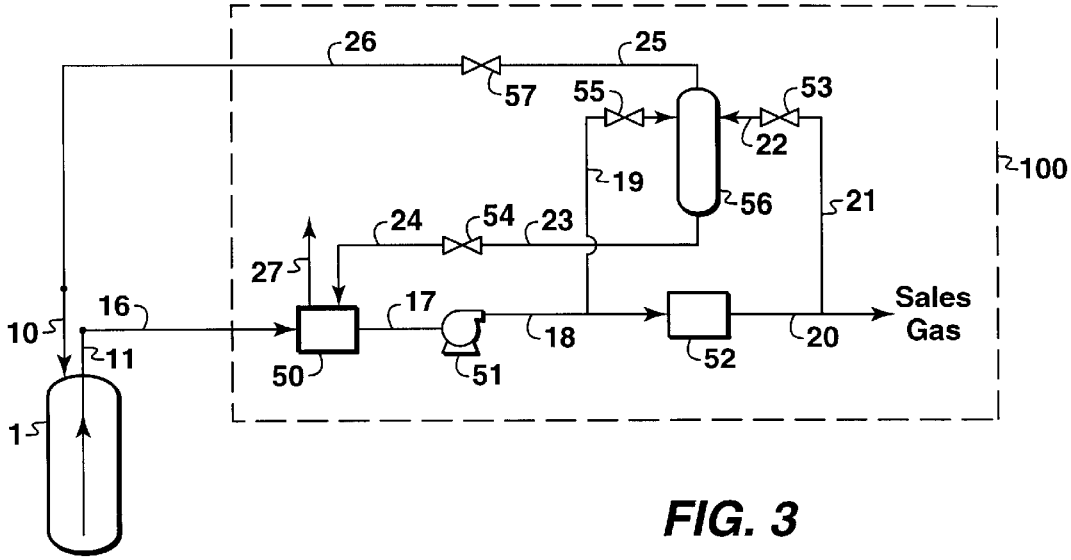
FIG. 3 is a schematic flow diagram for unloading PLNG from a first container or group of containers using the displacing gas produced by a process of this invention.

FIG. 3 illustrates another embodiment of a process for producing displacement gas for unloading PLNG from one or more containers. In the embodiment illustrated in FIG. 3, the process to generate displacement gas is shown generally by the reference numeral 100. In FIG. 3, the displacement gas process 100 is shown connected to containers 1 and 2, which may be containers on a ship. In the unloading process described below with reference to FIGS. 3–5, the process 100 provides displacement gas only for the process illustrated in FIG. 3. After PLNG has been displaced from container 1 by the displacing gas produced by process 100, PLNG in the remaining containers on the ship can be displaced by gas obtained from previously emptied containers. Therefore, process 100 in the following description is used to provide displacement gas for unloading PLNG from the first container or group of containers or if additional gas is required during the unloading of subsequent containers.

Figure 2:
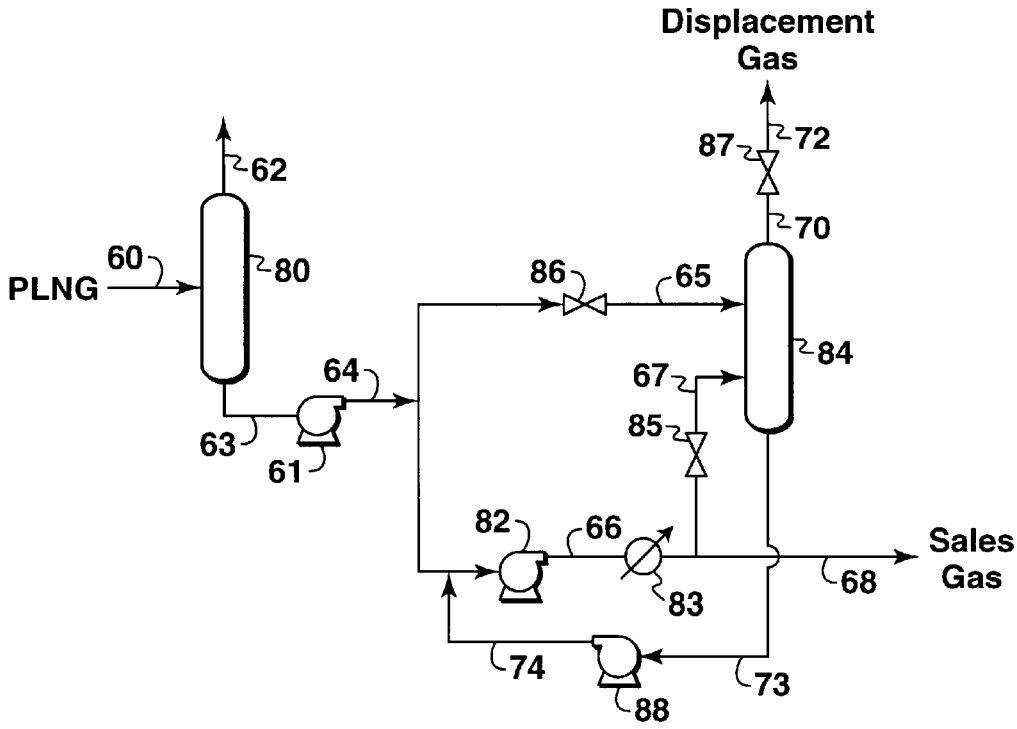
FIG. 2 is a schematic flow diagram of one embodiment of a process for producing a displacement gas from a multi-component, pressurized, liquefied gas rich in methane for use in displacing a pressurized liquefied gas from one or more containers.

The process in FIG. 2 can be interchanged for the process 100 in FIG. 3. Flow line 26 of FIG. 3 corresponds to flow line 72 of FIG. 2 and flow line 16 of FIG. 3 corresponds to flow line 60 of FIG. 2.

Figure 4:
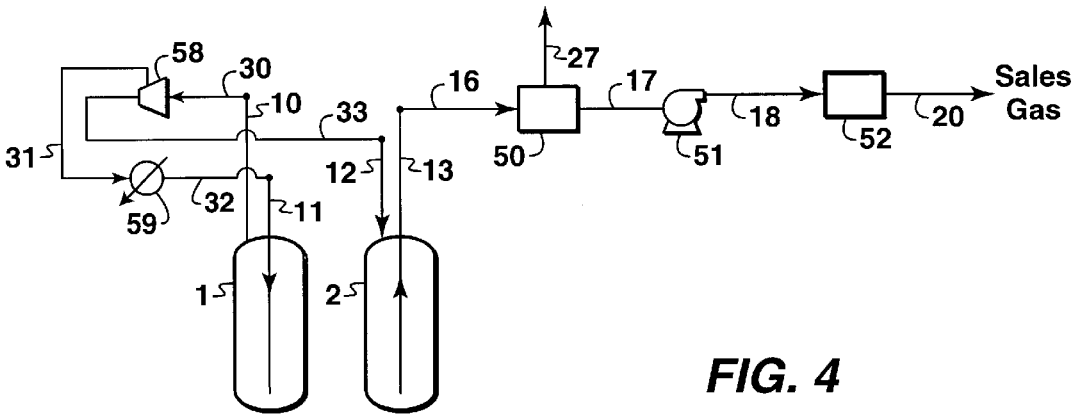
FIG. 4 is a schematic flow diagram for displacing PLNG from a second container or group of containers by evacuating the first container or group of containers to a low pressure.
Figure 5:
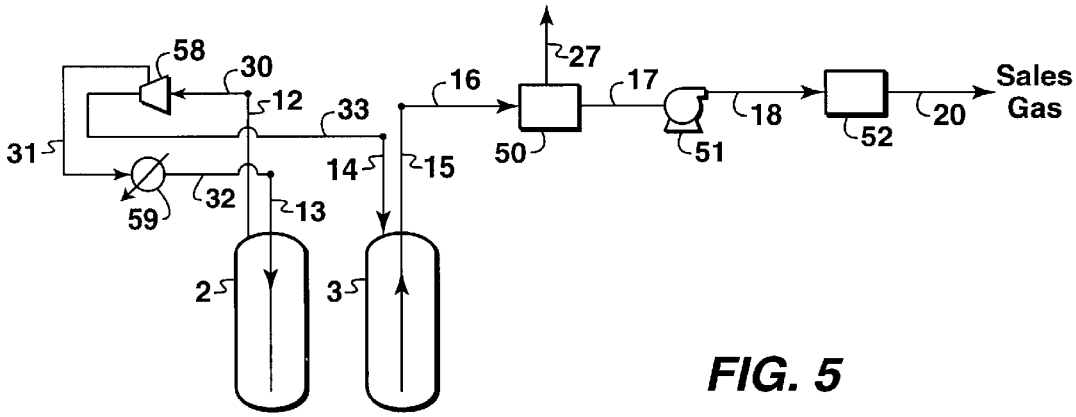
FIG. 5 is a schematic flow diagram for displacing PLNG from a third container or group of containers by evacuating the second container or group of containers to a low pressure.

FIGS. 3–5 illustrate flowline arrangement for unloading PLNG from a plurality of containers on a ship. The piping and emptying methods described in FIGS. 3–5 provide one method for unloading PLNG-bearing tanks. Other piping and emptying methods could be used depending on the placement of the tanks and the governing regulatory bodies. Currently, governmental regulations typically require that containers on ships have only top connections, thus limiting unloading to either pumping or pressuring out if pressure is maintained during the unloading process. If onshore facilities permitted bottom connections, the unloading flowlines shown in FIGS. 3–5 could be simplified.

Referring to FIGS. 3–5, a method for removing PLNG from containers 1, 2, and 3 will now be described. For the sake of simplifying the description of the unloading method, only three containers are shown in the FIGS. 3–5. It should be understood that displacement gas of process 100 is not limited to a particular number of containers or groups of containers. A ship designed for transporting pressurized liquefied gas could have several hundred pressurized PLNG containers. The piping between the plurality of tanks can be so arranged that the containers can be unloaded one container at a time in succession or unloaded in groups, and any container is a series or any group can be unloaded or discharged in any sequence. The unloading sequence from a floating carrier should take into account the trim and stability of the container carrier which would be familiar to those skilled in the art.

Each container or group of containers is provided with pressure relief valves, pressure sensors, fluid level indicators, and pressure alarms systems and suitable insulation for cryogenic operation. These systems are omitted from the figures since those skilled in the art are familiar with the construction and operation of such systems, which are not essential to understanding the unloading method described in FIGS. 3–5.

Referring to FIG. 3, to discharge PLNG from container 1 or a first group of containers, pressurized displacement gas is passed through line 10 to discharge PLNG from container 1 through line 11 which extends from near the bottom of container 1 though the top of container 1 and is connected to line 16. Line 11 extends to near the bottom of container 1 to maximize removal of PLNG by the displacement gas. The displacement gas for use in container 1 may come from any suitable source. For example, the displacement gas may be supplied by one or more auxiliary storage tanks or containers, from containers on the ship from which PLNG had previously been removed, or from PLNG that is vaporized. This latter source will now be described in more detail by referring to a vaporization process shown schematically in FIG. 2.

The PLNG discharged through line 11 passes through line 16 to a pump surge tank 50. From the pump surge tank 50 PLNG is passed by line 17 to pump 51 which pumps the PLNG to the desired delivery pressure of the sales gas. The high pressure PLNG exits the pump 51 by line 18 and is passed to vaporizing unit 52, except for a small fraction, preferably from about 5% to 10% of stream 18 that is withdrawn through line 19, passed through a suitable expansion device 55, such as a Joule-Thomson valve, and passed into a separation means 56.

Vaporizer 52 can be any conventional system for re-vaporizing the liquefied gas, which are well known to those skilled in the art. The vaporizer 52 may for example use a heat transfer medium from an environmental source such as air, sea water, or fresh water or the PLNG in the vaporizer may serve as a heat sink in a power cycle to generate electrical energy. A portion, preferably from about 5% to 10%, of the sales gas (line 20) exiting the PLNG vaporizer 52 may be withdrawn through line 21 and passed through an expansion device 53, such as a Joule-Thomson valve, to reduce the gas pressure. From the expansion device 53, the expanded gas enters the separation means 56 by line 22. A liquid stream 23 is withdrawn from the bottom the separation means 56 and passed through an expansion device 54 to reduce the pressure of the liquid before it is passed by line 24 to the PLNG pump surge tank 50. The overhead vapor from the separator 56 is passed through line 25, through an expansion device 57, such as a Joule-Thomson valve, to lower the pressure of the gas. After exiting the expansion device 57, the displacement gas is passed by line 10 into the top of container 1. Once the PLNG in container 1 has been substantially discharged therefrom, injection of displacement gas into container 1 is stopped. At this stage of the process, container 1 is full of relatively high-pressure displacement gas. It is desirable to remove this high-pressure gas from container 1 to further reduce the mass of hydrocarbons in container 1.

Over time, excess vapor may buildup in the surge tank 50. This excess vapor can be removed through flow line 27 which can be connected to any suitable device depending on the design of the unloading system. Although not shown in the drawings, the excess vapor for example may be compressed and passed into separator 56, it may be passed to a fuel gas system for powering turbines or engines, or it may be combined with gas stream 31 of FIGS. 3 and 4 to become part of the recycle gas.

FIG. 4 shows the principal gas and liquid flow lines used in the process of this invention for displacing liquid from container 2. In FIGS. 3, 4, and 5, flow lines and other equipment having like numerals have the same process functions. Those skilled in the art will recognize, however, that the flow lines sizes and flow rates may vary in size and capacity to handle different fluid flow rates and temperatures from one container to another.

Referring to FIG. 4, the high pressure displacement gas in container 1 at the end of the PLNG discharging step (the process depicted in FIG. 3) is removed through line 10 and passed through line 30 (which is connected to line 10) and passed to one or more compressors 58. A portion of the compressed displacement gas is withdrawn from the compressor through line 31 and passed to a heat exchanger 59 which heats the gas to a temperature between about −50° C. and about 10° C. Any suitable heat transfer medium may be used for indirect heat exchange with the compressed displacement gas in heat exchanger 59. Nonlimiting examples of suitable heat sources may include exhaust gases from ship engines and environmental sources such as air, salt water, and fresh water.

From the heat exchanger 59, the heated gas is introduced to the bottom of container through line 11, which is in communication with the heat exchanger through line 32. The remaining fraction of the displacement gas that was compressed by compressor 58 is passed through line 33 and line 12 into container 2 to displace PLNG from container 2 through line 13. The PLNG is then revaporized in the same manner as described above with respect to PLNG removed from container 1. Since the displacement gas for container 2 is obtained from the high-pressure gas in container 1, separator 56 and vapor therefrom may not be needed to provide displacement gas for container 2 or other containers unloaded in the series.

FIG. 5 shows the principal gas and liquid flow lines used for displacing liquid from container 3 and removing a at least a portion of the high pressure displacement gas from container 2 by lowering the gas pressure. High-pressure displacement gas is used to displace PLNG from container 2 is withdrawn from container 2 by the suction of compressor 58. The high-pressure displacement gas passes from container 2 through lines 12 and 30 to one or more compressors 58 to boost the gas pressure. A fraction of the compressed displacement gas is withdrawn from the compressor through line 31 and passed to a heat exchanger 59 wherein the gas is heated. From the heat exchanger 59, the heated displacement gas is introduced to the bottom of container 2 through line 13, which is in fluid communication with the heat exchanger through line 32. The remaining fraction of the gas compressed by compressor 58 is passed through lines 33 and 14 into container 3 to displace PLNG from container 3 through line 15. The PLNG from container 3 is then revaporized in the same manner as described above with respect to PLNG removed from container 2. Unloading of all containers on a carrier ship or onshore facility is continued as described above until the last container (or group of containers) is unloaded. In the practice of this unloading method, all of the containers are full of low-pressure gas except the last container or group of containers. The last container in the series, container 3 in this description, is left at or above the bubble point pressure of the PLNG to facilitate reloading of PLNG on the return trip for reloading of PLNG.

If the low pressure displacement gas is derived from the PLNG as described in this description, the mass of low pressure gas remaining in the containers after unloading of PLNG will represent about 1 to 3 percent of the mass of the original load of PLNG. The temperature and pressure of the gas will at all times during the unloading process be within the minimum design temperature and maximum design pressure for the containers.

As the displacement gas is introduced into the containers to discharge PLNG, the pressure of the displacement gas is preferably regulated so as to keep the pressure of the PLNG at the bottom of the containers essentially constant. This is desirable to increase container cargo capacity for a given wall thickness by minimizing the maximum design pressure and to prevent flashing of the PLNG at the top of the downcomer during unloading. Depending on the design criteria for construction of the containers, avoiding any decrease of the temperature of the PLNG in the containers may be desirable to avoid dropping the temperature below the design temperature for the container.

To further guard against any lowering of the temperature during the step of discharging PLNG, the displacement gas may optionally be heated prior to entering the containers.

EXAMPLE

A hypothetical mass and energy balance was carried out to illustrate the embodiment illustrated in the FIG. 2 and the results are set forth in the Table below.

The data presented in the Table are offered to provide a better understanding of the pressure and temperature of flow streams shown in FIG. 2, but the invention is not to be construed as unnecessarily limited thereto. The temperatures, pressures, and compositions are not to be considered as limitations upon the invention that can have many variations in cargo compositions and flow rates in view of the teachings herein.

A person skilled in the art, particularly one having the benefit of the teachings of this patent, will recognize many modifications and variations to the specific processes disclosed above. For example, a variety of temperatures and pressures may be used in accordance with the invention, depending on the overall design of the system and the composition of the PLNG. Also, the piping connections between the PLNG containers may be supplemented or reconfigured depending on the overall design requirements to achieve optimum and efficient heat exchange requirements. As discussed above, the specifically disclosed embodiments and examples should not be used to limit or restrict the scope of the invention, which is to be determined by the claims below and their equivalents.

TABLE

| Stream | Phase: Liquid/ Vapor | Temp. Deg C. | Temp. Deg F. | Pressure kPa | Pressure psia | Flowrate KgMol/hr | Flowrate #mol/hr | Composition $C_1$ mol % | $C_2$ mol % | $C_3$ mol % | $C_4$ mol % | $C_5$ mol % | $N_2$ mol % | $CO_2$ mol % |
|---|---|---|---|---|---|---|---|---|---|---|---|---|---|---|
| 60 | Liq | −95.2 | −140.0 | 2623 | 380.4 | 38,932 | 85,830 | 85.67 | 8.03 | 4.50 | 1.23 | 0.03 | 0.53 | 0.01 |
| 62 | Vap | −95.2 | −140.0 | 2623 | 380.4 | 0 | 0 | 96.76 | 0.75 | 0.07 | 0.00 | 0.00 | 2.42 | 0 |
| 63 | Liq | −95.2 | −140.0 | 2623 | 380.4 | 38,932 | 85,830 | 85.67 | 8.03 | 4.50 | 1.23 | 0.03 | 0.53 | 0.01 |
| 64 | Liq | −93.7 | −137.3 | 4002 | 580.4 | 38,932 | 85,830 | 85.67 | 8.03 | 4.50 | 1.23 | 0.03 | 0.53 | 0.01 |
| 65 | Liq | −93.8 | −137.5 | 3448 | 500.0 | 4,536 | 10,000 | 85.67 | 8.03 | 4.50 | 1.23 | 0.03 | 0.53 | 0.01 |
| 66 | Liq | −86.8 | −124.9 | 8620 | 1250.0 | 36,941 | 81,440 | 83.62 | 9.19 | 5.23 | 1.43 | 0.03 | 0.49 | 0.01 |
| 67 | Vap/Liq | −28.9 | −20.6 | 3138 | 455.0 | 3,580 | 7,892 | 83.62 | 9.19 | 5.23 | 1.43 | 0.03 | 0.49 | 0.01 |
| 68 | Vap | 2.0 | 35.0 | 8448 | 1225.0 | 33,362 | 73,550 | 83.62 | 9.19 | 5.23 | 1.43 | 0.03 | 0.49 | 0.01 |
| 69 | Liq | −67.6 | −90.3 | 3482 | 505.0 | 2,546 | 5,612 | 55.75 | 24.82 | 15.06 | 4.18 | 0.10 | 0.06 | 0.03 |
| 70 | Vap | −86.1 | −123.5 | 3448 | 500.0 | 5,570 | 12,280 | 98.04 | 1.10 | 0.14 | 0.00 | 0.00 | 0.72 | 0 |
| 73 | Liq | −67.1 | −89.3 | 4069 | 590.0 | 2,546 | 5,612 | 55.75 | 24.82 | 15.06 | 4.18 | 0.10 | 0.06 | 0.03 |

What is claimed is:

1. A process for producing a displacement gas from a multi-component, pressurized, liquefied gas rich in methane to be used in displacing a pressurized liquefied gas from one or more containers, comprising the steps of:

(a) increasing the pressure of the multi-component, pressurized, liquefied gas and separating it into a first fraction and a second fraction;

(b) expanding the first fraction to reduce its pressure and passing the expanded fraction to a separation means which produces a liquid stream and a vaporous stream;

(c) heating the second fraction to covert it to a vaporous stream;

(d) withdrawing a portion of the vaporous product stream, expanding the withdrawn portion to reduce it pressure and temperature, and passing it to the separation means, and discharging the remaining portion as a vaporous product;

(e) recycling the liquid product produced by the separator by combining the liquid product with the multi-component, pressurized, liquefied gas before pressurization in step (a);

(f) expanding the gas stream produced by the separation means to reduce its pressure and temperature, and (g) using the expanded gas stream to displace liquefied gas from one or more containers.

2. The process of claim 1 wherein the expanded gas stream of step (g) has a temperature above −112° C.

3. The process of claim 1 wherein the multi-component, pressurized, liquefied gas pressurized in step (a) has essentially the same composition as the liquefied gas to be displaced.

4. The process of claim 1 wherein the separation means is a separation means.

5. The process of claim 1 wherein the separation means is a fractionator.

6. The process of claim 1 wherein the pressure of the gas of step (g) ranges from about 20 kPa to 345 kPa (3 to 50 psia) more than the bubble point pressure of the liquefied gas to be displaced.

7. The process of claim 1 further comprising before step (a) the additional step of passing the multi-component, pressurized, liquefied gas to a pump surge tank.

8. The process of claim 1 wherein the pressurization of the multi-component, pressurized, liquefied gas is performed by at least one pump.

9. A process for producing a displacement gas from a multi-component, pressurized, liquefied gas rich in methane to be used in displacing a pressurized liquefied gas from one or more containers, comprising the steps of:

(a) increasing the pressure of the multi-component, pressurized, liquefied gas by a first pump and separating it into a first fraction and a second fraction;

(b) expanding the first fraction to reduce its pressure and passing the expanded fraction to a separation means which produces a liquid stream and a vaporous stream;

(c) further increasing the pressure of the second fraction by a second pump;

(d) heating the second fraction to covert it to a vaporous stream;

(e) withdrawing a portion of the vaporous product stream, expanding it to reduce its pressure and temperature, passing it to the separation means, and discharging the remaining portion of the vaporous product as a vaporous product;

(f) recycling the liquid product produced by the separation means by increasing the pressure of the liquid product by a third pump, and thereafter combining the liquid product with the pressurized multi-component, pressurized, liquefied gas after being pressurized by the second pump;

(g) expanding the gas stream produced by the separation means to reduce its pressure and temperature; and (h) using the expanded gas stream of step (g) to displace liquefied gas from one or more containers.

* * * * *